US008599040B2

(12) United States Patent
Malaska

(10) Patent No.: US 8,599,040 B2
(45) Date of Patent: Dec. 3, 2013

(54) VEHICLE TRAFFIC SIGNAL TRANSMISSION NOTIFICATION SYSTEM FOR A DRIVER

(76) Inventor: Colin M. Malaska, Redmond, WA (US)

( * ) Notice: Subject to any disclaimer, the term of this patent is extended or adjusted under 35 U.S.C. 154(b) by 221 days.

(21) Appl. No.: 13/199,824

(22) Filed: Sep. 9, 2011

(65) Prior Publication Data

US 2013/0063281 A1 Mar. 14, 2013

(51) Int. Cl.
*G08B 21/00* (2006.01)

(52) U.S. Cl.
USPC ..... 340/905; 340/901

(58) Field of Classification Search
USPC ..... 340/901, 902, 903, 904, 905, 911, 916, 340/933–943
See application file for complete search history.

(56) References Cited

U.S. PATENT DOCUMENTS

| | | | | |
|---|---|---|---|---|
| 4,591,823 | A * | 5/1986 | Horvat | 340/936 |
| 6,262,673 | B1 * | 7/2001 | Kalina | 340/901 |
| 7,663,505 | B2 | 2/2010 | Publicover | |
| 7,689,347 | B2 | 3/2010 | Wall | |
| 7,821,422 | B2 | 10/2010 | Hutchison | |
| 7,860,639 | B2 | 12/2010 | Yang | |
| 7,902,998 | B2 | 3/2011 | Wheaton | |
| 7,953,546 | B1 | 5/2011 | Wall | |
| 2009/0224942 | A1 * | 9/2009 | Goudy et al. | 340/905 |

* cited by examiner

*Primary Examiner* — Jeffery Hofsass

(57) ABSTRACT

A system, device and method for notifying a vehicle driver of the condition of an upcoming vehicle traffic signal is described. The system includes a transmitter; transmission circuitry operably coupled to a vehicle traffic signal controller and operably coupled to the transmitter; wherein the transmission circuitry receives information associated with vehicle traffic signal status from the vehicle traffic signal controller, and causes the transmitter to transmit a non-visual and non-audible signal including information associated with the vehicle traffic signal status; a mobile receiver unit including a receiver to receive the transmitted non-visual signal; and a communication mechanism coupled to the mobile receiver unit to communicate information associated with the vehicle traffic signal status to a driver or user.

22 Claims, 6 Drawing Sheets

VEHICLE TRAFFIC SIGNAL TRANSMISSION NOTIFICATION SYSTEM FOR A DRIVER

SUMMARY

A system, device and method for notifying a vehicle driver of the condition of an upcoming vehicle traffic signal is described. The system includes a transmitter; transmission circuitry operably coupled to a vehicle traffic signal controller and operably coupled to the transmitter; wherein the transmission circuitry receives information associated with vehicle traffic signal status from the vehicle traffic signal controller, and causes the transmitter to transmit a non-visual and non-audible signal including information associated with the vehicle traffic signal status; a mobile receiver unit including a receiver to receive the transmitted non-visual signal; and a communication mechanism coupled to the mobile receiver unit to communicate information associated with the vehicle traffic signal status to a driver or user.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
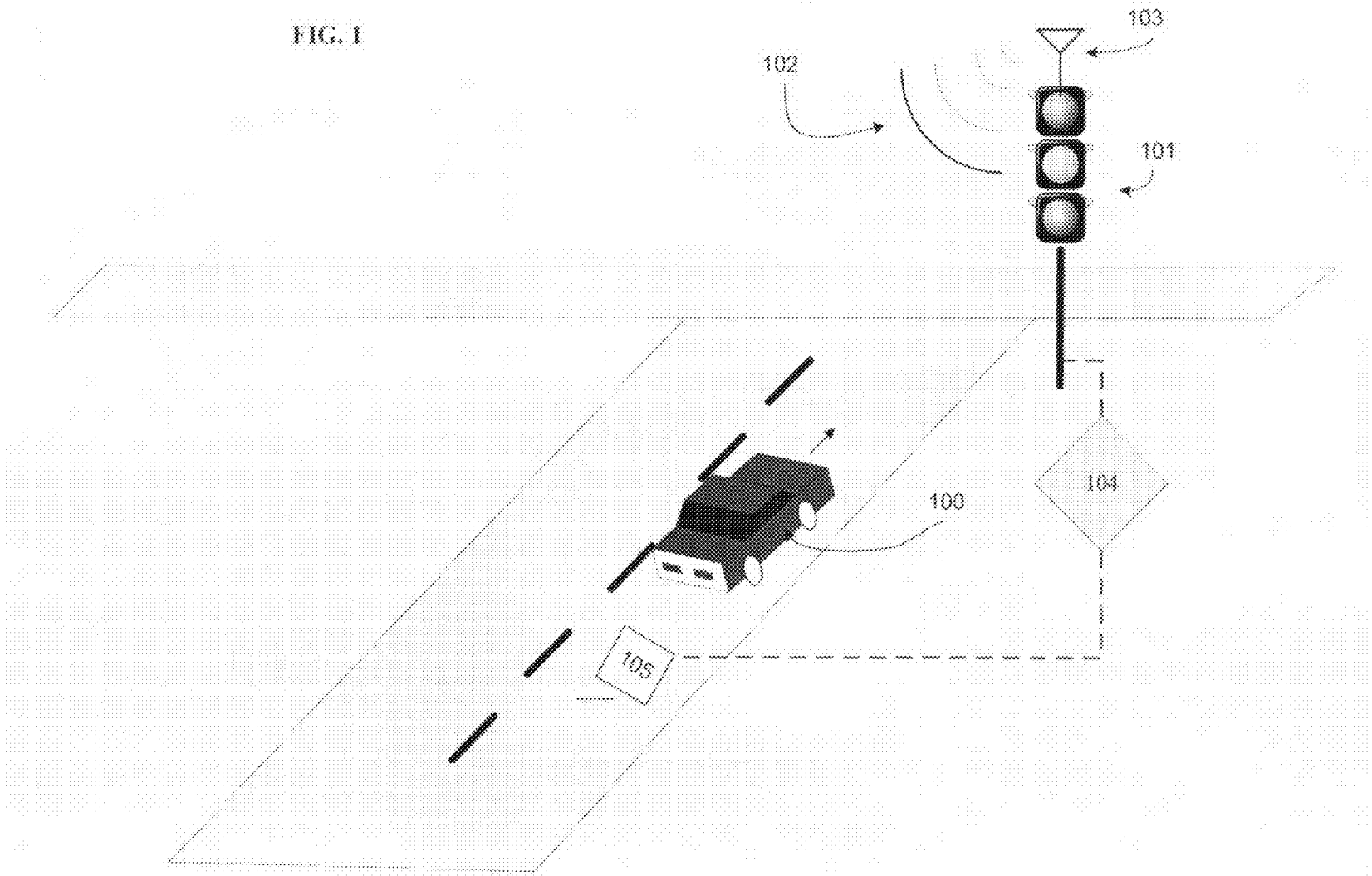
FIG. 1 is an illustration of an aspect of the invention regarding a vehicle approaching a traffic signal.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

In an embodiment, the vehicle traffic signal notification system is useful when approaching drivers are not able to visibly see the vehicle traffic signal lights or the stop or yield sign. This may be due to a curve in the road, a hill, a building, trees, vegetation, or weather conditions, for example. In heavy fog conditions, it is often difficult to see the status of a vehicle traffic signal light ahead of the vehicle. Further, numerous accidents occur due to drivers running red lights in heavy fog and colliding with a vehicle entering the intersection. In an embodiment, the vehicle traffic signal notification system described herein would notify the driver in advance of the status of the signal he/she is approaching, even when the traffic control signal is not visible.

In an aspect, a vehicle traffic signal notification system is disclosed including a transmitter; a transmission circuitry operably coupled to a vehicle traffic signal controller and operably coupled to the transmitter; wherein the transmission circuitry receives information associated with vehicle traffic signal status from the vehicle traffic signal controller, and causes the transmitter to transmit a non-visual and non-audible signal including information associated with the vehicle traffic signal status; a mobile receiver unit including a receiver to receive the transmitted non-visual and non-audible signal; and a communication mechanism coupled to the mobile receiver unit to communicate information associated with the vehicle traffic signal status to a user.

In an embodiment, the non-visual and non-audible signal including information associated with the vehicle traffic signal status can be a digital signal or an analog signal. The term "non-visual" means that the signal is not visible to a human. The term "non-audible" means that the signal is not audible to a human. It is understood that the specific configuration and components of circuitry necessary to produce a digital or analog signal can take many forms and variations and is well known in the art.

In an embodiment, the vehicle traffic signal notification system can further include detection circuitry operably coupled to the vehicle traffic signal controller to detect an approaching vehicle. The detection circuitry can be a receiver for receiving a signal from an approaching vehicle, or a physical detector such as a weight or motion sensor located near or on the road. The received signal from the approaching vehicle is processed by the detection circuitry to activate the transmission of the vehicle traffic status signal back to the approaching vehicle. Such a system can allow for the transmission of the vehicle traffic status signal on a car-by-car basis instead of a constant transmission.

The vehicle traffic signal status can be any of, for example, red, yellow or green, or amber. An embodiment includes the detection circuitry to detect whether the vehicle traffic signal status is a flashing signal or a constant signal. In an embodiment, the vehicle traffic signal notification system can be used to indicate the presence of a stop or yield sign.

In an embodiment, the transmitter can include a radio frequency transmitter. The radio frequency transmitter can be at least one of an AM radio frequency transmitter, a FM transmitter, an ultrasonic frequency transmitter, or a microwave frequency transmitter. Typically, and without limitation, radio frequency is a rate of oscillation in the range of about 30 kHz to 300 GHz, which corresponds to the frequency of radio waves, and the alternating currents that carry radio signals.

In an embodiment, the transmitter can include a directional antenna. The directional antenna is substantially pointed, and transmits, in the direction toward oncoming vehicle traffic. A directional antenna or beam antenna is an antenna that radiates greater power in one or more directions allowing for increased performance to transmit and receive and reduce interference from unwanted sources. Directional antennas, such as Yagi-Uda antennas, can provide increased performance over dipole antennas when a greater concentration of transmitted signal in a certain direction is desired.

Any conventional directional antenna is contemplated and includes, for example, Yagi antenna, AWX antenna, cantenna, collinear antenna, fractal antenna, ground dipole, helical antenna, horizontal curtain antenna, horn antenna, inverted vee antenna, log-periodic antenna, loop antenna, microstrip antenna, patch antenna, phased array antenna, parabolic antenna, plasma antenna, quad antenna, reflective array antenna, regenerative loop antenna, rhombic antenna, sector antenna, short backfire antenna, slot antenna, turnstile antenna, and vivaldi-antenna.

Other types of antenna(e) are contemplated for transmitting the vehicle traffic status signal. An omni-directional antenna may be used when transmitting the status of a 4-way stop, for example.

The distance of the non-visual and non-audible vehicle traffic signal that is broadcast or transmitted from the transmitter can be modulated depending on numerous factors including vehicle traffic conditions, including the average speed or volume of traffic, weather conditions, distance between intersections, etc. For example, for non-visual and non-audible vehicle traffic signals in urban areas, the broadcast range will be less than in more open rural areas, for example. Also, for roads that have higher speed limits, the broadcast or transmission range will be greater, or at a farther distance. This is to allow the vehicle that receives the vehicle traffic condition signal enough time to stop or slow down prior to the vehicle traffic signal. The broadcast strength should be minimized to prevent interference with a different traffic signal's status.

In an embodiment, the mobile receiver unit includes a receiver having a receiving antenna to receive the incoming non-visual and non-audible signal including information associated with a vehicle traffic signal status. In addition, the mobile receiver unit includes circuitry to process the received non-visual and non-audible signal and activate a communication mechanism. The receiving antenna can include any antenna configured to receive the transmitted non-visual and non-audible signal. In an embodiment, the receiving antenna includes a directional antenna, oriented in the direction of forward travel of the vehicle. Other antennas described herein for the transmitter antenna are also suitable and contemplated for the mobile receiver antenna. Any such receiving antenna can be configured and located on the vehicle to receive the transmitted signal in the direction to which the vehicle is travelling. The receiving antenna can include an antenna to receive a signal transmitted in radio frequency, microwave frequency, ultrasonic frequency, etc. The radio frequency receiver can be at least one of an AM radio frequency receiver, a FM receiver, an ultrasonic frequency receiver, or a microwave frequency receiver. Typically, and without limitation, radio frequency is a rate of oscillation in the range of about 30 kHz to 300 GHz, which corresponds to the frequency of radio waves, and the alternating currents that carry radio signals.

In an embodiment, the mobile receiver unit includes a communication mechanism including circuitry and/or hardware to process the received non-visual and non-audible signal including information associated with a vehicle traffic signal status and to activate the appropriate perceptible communication signal to a user (e.g., driver). For example, and without limitation, a logic circuit can simply determine the frequency or other characteristic of the transmitted non-visual and non-audible signal including information associated with a vehicle traffic status and then activate a circuit associated with the communication mechanism that engages a user-audible and/or user-visible communication signal. Such logic circuits can be of any configuration and such configuration can be readily determinable by those having skill in the art.

In an embodiment, the communication mechanism can include circuitry and/or hardware to produce an audible and/or visible user communication signal perceptible to, for example, the driver of the vehicle. The user communication signal can include a haptic signal felt by the vehicle driver via the steering wheel or via the seat, or both. Such haptic signal can include a simple activation of a vibration mechanism coupled to the steering wheel and/or seat. The communication mechanism can include a series of visible lights similar to a traffic signal having for example, red, yellow, green and/or amber lights. In an aspect, the communication mechanism can be circuitry configured to activate a light that is visible to the driver. The visible light may be red, yellow, green or amber. The visible light may flash or remain "on" in a steady state. It is contemplated that in order to indicate a relative distance to the traffic signal, the visible light may flash at an interval that decreases as the vehicle approaches the traffic signal, and can eventually remain as a steady "on" signal to indicate the traffic signal is very near.

In an embodiment, the communication mechanism can include circuitry combined with an audio speaker to provide voice communication to the driver/user. The communication mechanism can include a non-volatile memory for storing various voice commands similar to a GPS-type navigation system. The communication mechanism can inform a driver that an upcoming vehicle traffic signal has a status of green, for example, and if combined with GPS-type of navigation or location circuitry, can notify the driver of the distance to the approaching vehicle traffic signal. In an aspect, and without limitation, the mobile receiver unit includes a communication mechanism including circuitry to process the received non-visual and non-audible signal including information associated with a vehicle traffic signal status and can include circuitry to process information regarding location, direction of travel and speed of the vehicle. The communication mechanism utilizes such information to calculate the time until the vehicle must stop. Using this information, the communication mechanism can determine when to activate the communication signal to the driver. For example, based on GPS information received, and the information received regarding the status of the approaching vehicle traffic signal, the communication mechanism can determine that the communication signal to the driver must be activated sooner for a vehicle travelling faster than for a vehicle travelling slower.

In an embodiment, the mobile receiver unit can include a transmitter than transmits a directional signal in the direction of travel. The signal is to be received by a vehicle traffic signal that includes the system described herein. Once the signal from the approaching vehicle is received by the traffic signal, it then activates its circuitry to transmit a reply signal that includes the mobile receiver unit includes a non-visual and non-audible signal including information associated with a vehicle traffic signal status.

In an embodiment, the mobile receiver unit can be mounted to a vehicle with at least a portion of the communication mechanism located at or near the dashboard or other area in proximity to the driver. The mobile receiver unit can be connected to the vehicle's power system. Alternatively, the receiver unit may be built into the vehicle's instrument panel. The receiving or transmitting antenna may be located exterior or interior to the vehicle.

In an embodiment, the communication mechanism can include a "heads-up display" that projects information onto the inside of the windshield area. Thus, the driver is able to continue operating the vehicle with eyes on the road and the traffic ahead while using the driver's peripheral vision to see the communicated signal projected onto the windshield. Alternatively, the placement of the projection can be such that the driver need only glance at the projected image to determine the nature of the communicated signal without taking their eyes away from the road or traffic.

The communication mechanism can include circuitry that is configured to activate a speaker to produce an audible driver communication signal such as a beep, chime, buzz or other audible signal that conveys a condition or status of the upcoming traffic signal status. The audible signal produced can include a series of audible signals and may change from one type to another as the traffic signal status changes. For example, if the traffic signal ahead of the vehicle is a red light, the audible signal conveyed to the driver is a beep or a certain audible tone. The audible signal can be a single beep (or tone) or a series of beeps (or tones) repeated at intervals until the signal changes status, e.g., to a green light. The interval between beeps can be decreased as the vehicle approaches the signal indicating a relative distance to the signal. Upon the change to a green light traffic signal, the audible signal conveyed can be set to change to a chime, for example. The audible signal can be set to repeat itself at regular intervals until the vehicle has passed through the intersection. Alternatively, each type of vehicle traffic signal status conditions can be communicated with various tones. The communication mechanism can be connected to the audio system to provide a signal that is audible over the speakers in the interior of the vehicle.

In an embodiment, a method of notifying a user of a vehicle traffic signal status includes transmitting, using a directional antenna directed toward oncoming vehicle traffic, a non-visual and non-audible radio frequency signal including information associated with the vehicle traffic signal status.

In an embodiment, a method of notifying a user of a vehicle traffic signal status includes transmitting, using a directional antenna directed toward oncoming vehicle traffic, a FM radio frequency signal including information associated with the vehicle traffic signal status.

In an embodiment, a method of notifying a user of a vehicle traffic signal status includes transmitting, using a directional antenna directed toward oncoming vehicle traffic, an AM radio frequency signal including information associated with the vehicle traffic signal status.

In an embodiment, a method of notifying a user of a vehicle traffic signal status includes transmitting, using a directional antenna directed toward oncoming vehicle traffic, an ultrasonic frequency signal including information associated with the vehicle traffic signal status.

In an embodiment, a method of notifying a user of a vehicle traffic signal status includes transmitting, using a directional antenna toward oncoming vehicle traffic, a microwave frequency signal including information associated with the vehicle traffic signal status.

In an embodiment, a method of notifying a user of a vehicle traffic signal status includes receiving, using a mobile receiver unit a non-visual and non-audible signal including information associated with the vehicle traffic signal status, and communicating a user-perceptible signal indicative of the vehicle traffic signal status.

In an embodiment, a method of notifying a user of a vehicle traffic signal status includes receiving, using a mobile receiver unit including a radio frequency receiver including a directional antenna, a non-visual and non-audible radio frequency signal including information associated with the vehicle traffic signal status, and communicating a user-perceptible signal indicative of the vehicle traffic signal status.

In an embodiment, the method of notifying a user of a vehicle traffic signal status includes receiving, using a mobile receiver unit including a FM radio frequency receiver including a directional antenna, a non-visual and non-audible FM frequency signal including information associated with the vehicle traffic signal status, and communicating a user-perceptible signal indicative of the vehicle traffic signal status.

In an embodiment, the method of notifying a user of a vehicle traffic signal status includes receiving, using a mobile receiver unit including an AM radio frequency receiver including a directional antenna, a non-visual and non-audible AM frequency signal including information associated with the vehicle traffic signal status, and communicating a user-perceptible signal indicative of the vehicle traffic signal status.

In an embodiment, the method of notifying a user of a vehicle traffic signal status includes receiving, using a mobile receiver unit including an ultrasonic frequency receiver including a directional antenna, a non-visual and non-audible ultrasonic frequency signal including information associated with the vehicle traffic signal status, and communicating a user-perceptible signal indicative of the vehicle traffic signal status.

In an embodiment, the method of notifying a user of a vehicle traffic signal status includes receiving, using a mobile receiver unit including a microwave frequency receiver including a directional antenna, a non-visual and non-audible microwave frequency signal including information associated with the vehicle traffic signal status, and communicating a user-perceptible signal indicative of the vehicle traffic signal status.

In an embodiment, the method of notifying a user of a vehicle traffic signal status includes communicating user-perceptible signal indicative of the vehicle traffic signal status.

In an embodiment, the method of notifying a user of a vehicle traffic signal status includes communicating user-visible information indicative of the vehicle traffic signal status. In an aspect, the user-visible information includes displaying at least one of a red, a yellow, a green and/or an amber light.

In an embodiment, the method of notifying a user of a vehicle traffic signal status includes communicating driver-visible information indicative of the vehicle traffic signal status. In an aspect, the driver-visible information includes displaying a heads-up display projected onto an area visible to the driver.

In an embodiment, the method of notifying a user of a vehicle traffic signal status includes communicating user-audible information regarding the vehicle traffic signal status. In an aspect, communicating the user-audible information includes communication to the driver by activating an audio speaker.

In an aspect, a method of receiving a notification of a vehicle traffic signal status includes activating a communication mechanism including at least one of a speaker to communicate user-audible information indicative of the vehicle traffic signal status, a display to display user-visible information indicative of the vehicle traffic signal status, and a haptic mechanism to deliver a user-perceptible haptic signal indicative of the vehicle traffic signal status.

In an embodiment, a method of receiving a notification of a vehicle traffic signal status includes transmitting a signal from a vehicle to a vehicle traffic signal, receiving a non-visual and non-audible radio frequency signal including information associated with the vehicle traffic signal status, and communicating a user-perceptible signal indicative of the vehicle traffic signal status.

As used herein, a vehicle includes an automobile, bus, bicycle, motorcycle, or any other means for transportation on a road having a vehicle traffic signal.

With reference to FIG. 1, vehicle 100 is approaching the road intersection having vehicle traffic signal 101. Optional detection circuitry 105 detects the presence of the vehicle 100 and provides a detection signal to a traffic signal controller 104. Traffic signal controller 104 includes circuitry that causes the broadcast or transmission of a traffic signal notification status 102 using traffic signal status transmission antenna 103. Transmission antenna 103 can be a directional antenna to broadcast or transmit generally, or more specifically, in the direction of the approaching vehicle 100. In addition, antenna 103 can also receive a signal from an approaching vehicle that queries the vehicle traffic signal 101 for a status. In response to receiving the query, the circuitry causes antenna 103 to transmit the status of the traffic signal.

Figure 2:
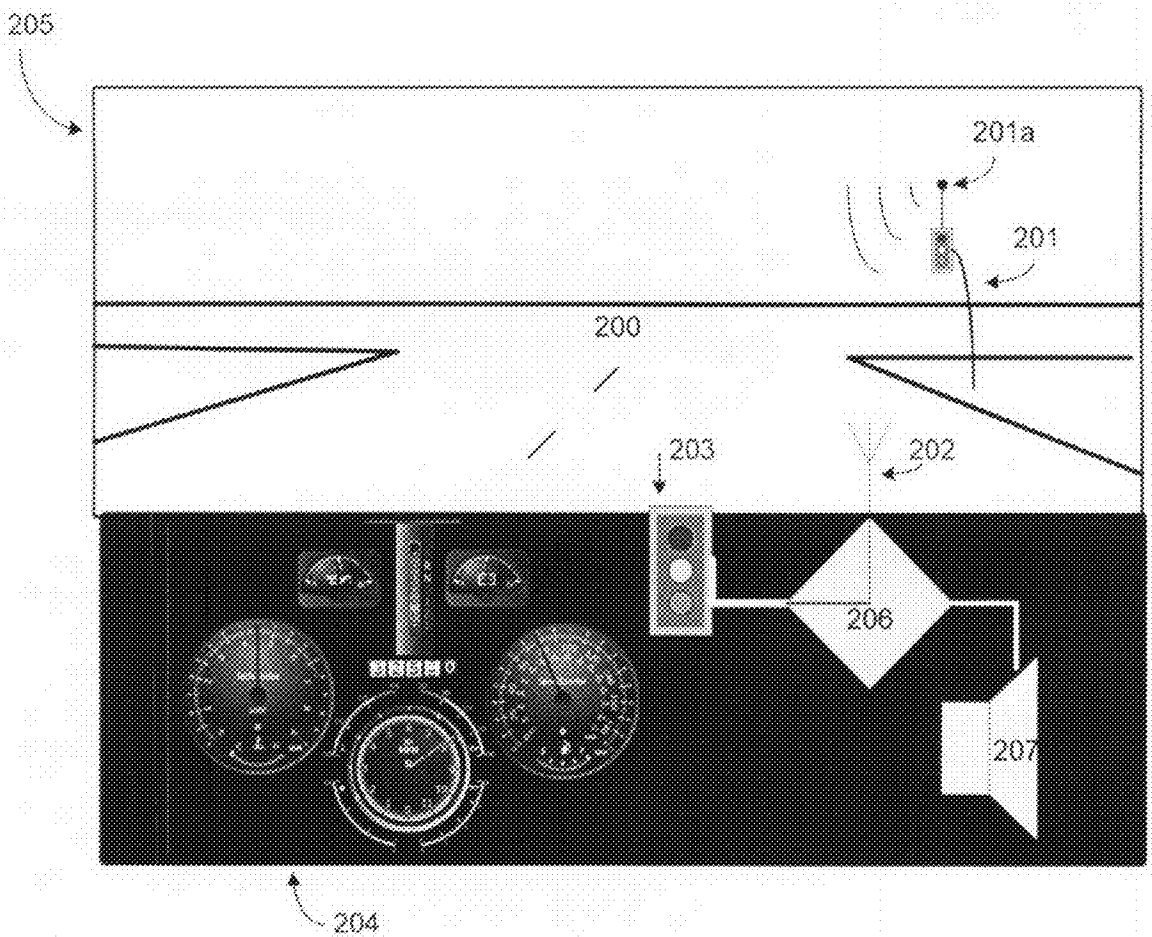
FIG. 2 is an illustration of an aspect of the invention as connected to a vehicle dashboard.

With reference to FIG. 2, a traffic intersection 200 includes a vehicle traffic signal 201 having a vehicle traffic signal status transmission antenna 201*a*. The perspective of FIG. 2 is as shown from an automobile driver's perspective, looking through windshield 205 with dashboard 204, and instrument gauges 210. FIG. 2 illustrates the mobile receiver unit 208 having a receiving antenna 202 and a communication mechanism 206. The communication mechanism 206 can include driver communication display 203. In FIG. 2, the driver communication display 203 is configured, as an embodiment, to resemble a vehicle traffic signal having red, yellow and green lights. In addition to, or alternative to, the driver communication display 203, the communication mechanism 206 can include circuitry operably connected to an audio speaker 207. Audio speaker 207 is activated by circuitry within communication mechanism 206 and provides an audible signal to the user (driver). Speaker 207 may be part of the communication mechanism 206 with a speaker that is distinct from the vehicle's internal audio speakers, or the communication mechanism 206 may be operably connected to the vehicle's internal audio speakers.

Alternatively, the communication mechanism 206 can be operably coupled to both types of speakers. In addition, or alternatively, to a display 203 and/or an audio speaker 207, a haptic signal can be sent to a haptically-perceptible mechanism 209, e.g., vibration, within the steering wheel or the driver's seat. In addition, antenna 202 can be a transmitter to transmit a signal in the direction of the vehicle travel to inform a vehicle traffic signal of the approaching vehicle and can query the vehicle traffic signal for a status.

Figure 3:
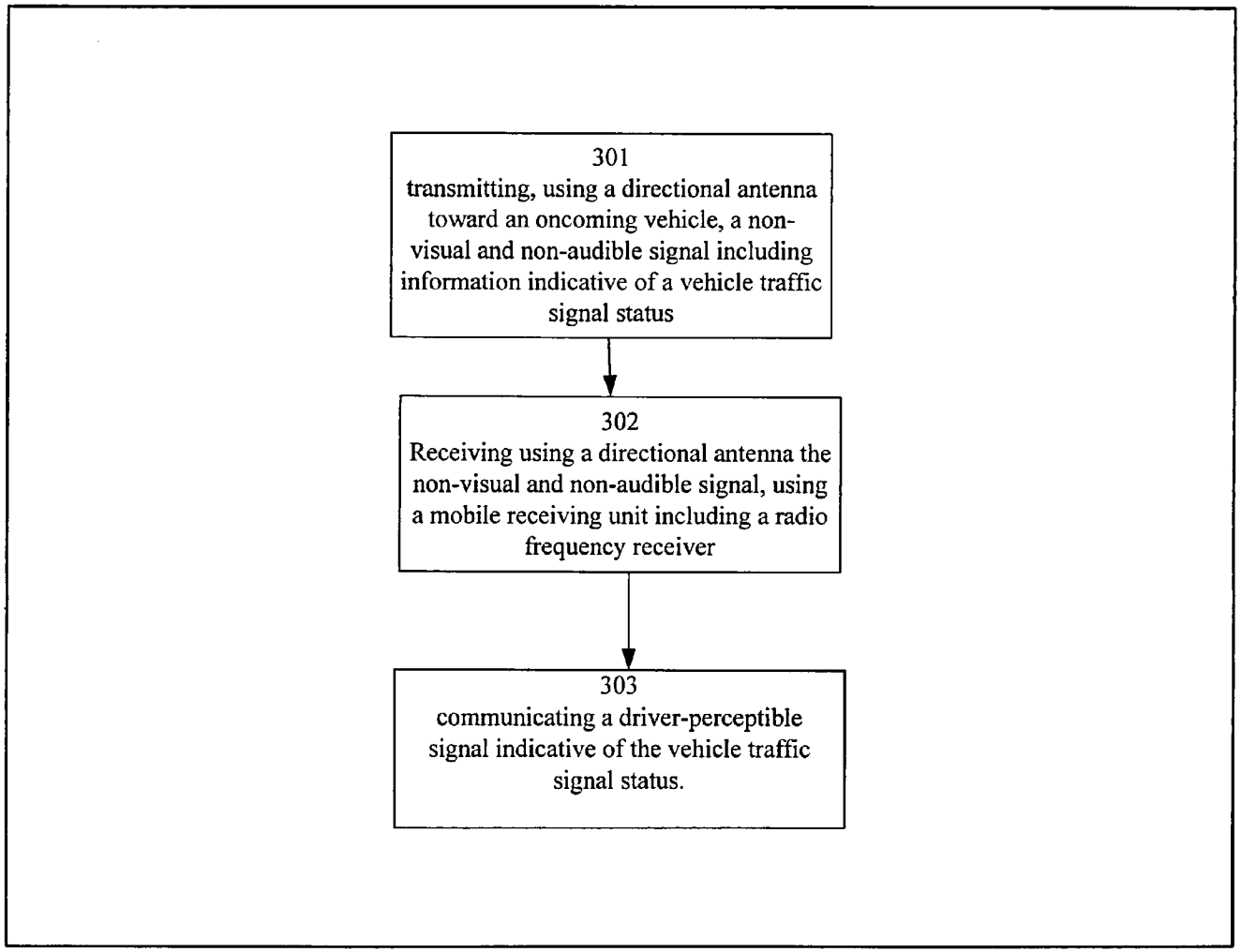
FIG. 3 is an illustration of an embodiment relating to a method.

With reference to FIG. 3, a method of notifying a user of a vehicle traffic signal status is illustrated. Reference numeral 301 includes transmitting, using an transmitter antenna directed toward oncoming vehicle traffic, a non-visual and non-audible signal including information associated with the vehicle traffic signal status. Reference numeral 302 includes receiving the non-visual and non-audible signal including information associated with the vehicle, using a mobile receiver unit including a radio frequency receiver including a receiving antenna. Reference numeral 303 includes communicating a driver-perceptible signal indicative of the traffic signal status.

Figure 4:
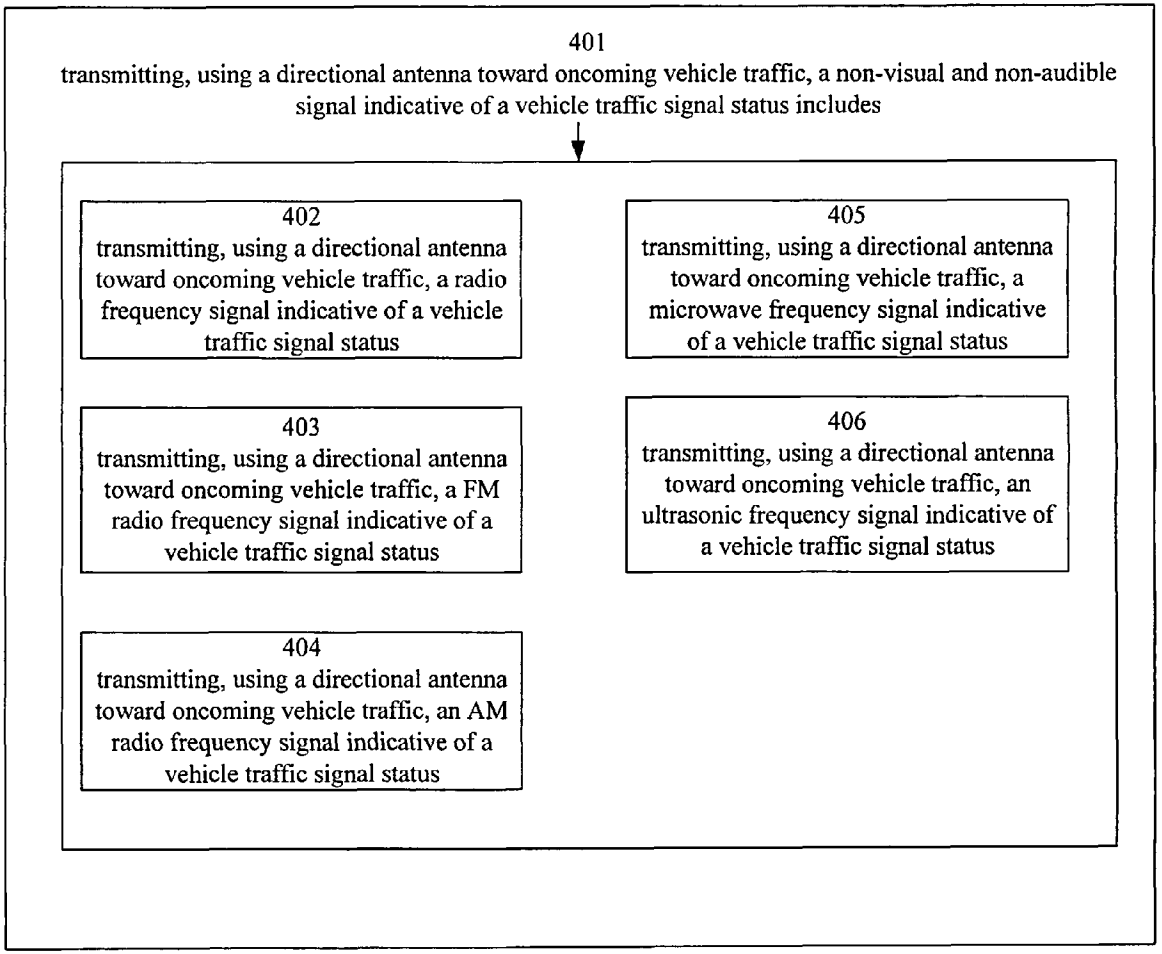
FIG. 4 is an illustration of an embodiment relating to a method.

With reference to FIG. 4, a method of transmitting a non-visual and non-audible signal including information associated with the vehicle traffic status is illustrated. Reference numeral 401 includes transmitting, using a directional antenna toward oncoming vehicle traffic, a non-visual and non-audible signal including information associated with the vehicle traffic signal status. Reference numeral 402 includes transmitting, using a directional antenna toward oncoming vehicle traffic, a radio frequency signal including information associated with the vehicle traffic signal status. Reference numeral 403 includes transmitting, using a directional antenna toward oncoming vehicle traffic, a FM frequency signal including information associated with the vehicle traffic signal status. Reference numeral includes 404 transmitting, using a directional antenna toward oncoming vehicle traffic, an AM radio frequency signal including information associated with the vehicle traffic signal status. Reference numeral 405 includes transmitting, using a directional antenna toward oncoming vehicle traffic, a microwave frequency signal including information associated with the vehicle traffic signal status. Reference numeral 406 includes transmitting, using a directional antenna toward oncoming vehicle traffic, an ultrasonic frequency signal including information associated with the vehicle traffic signal status.

Figure 5:
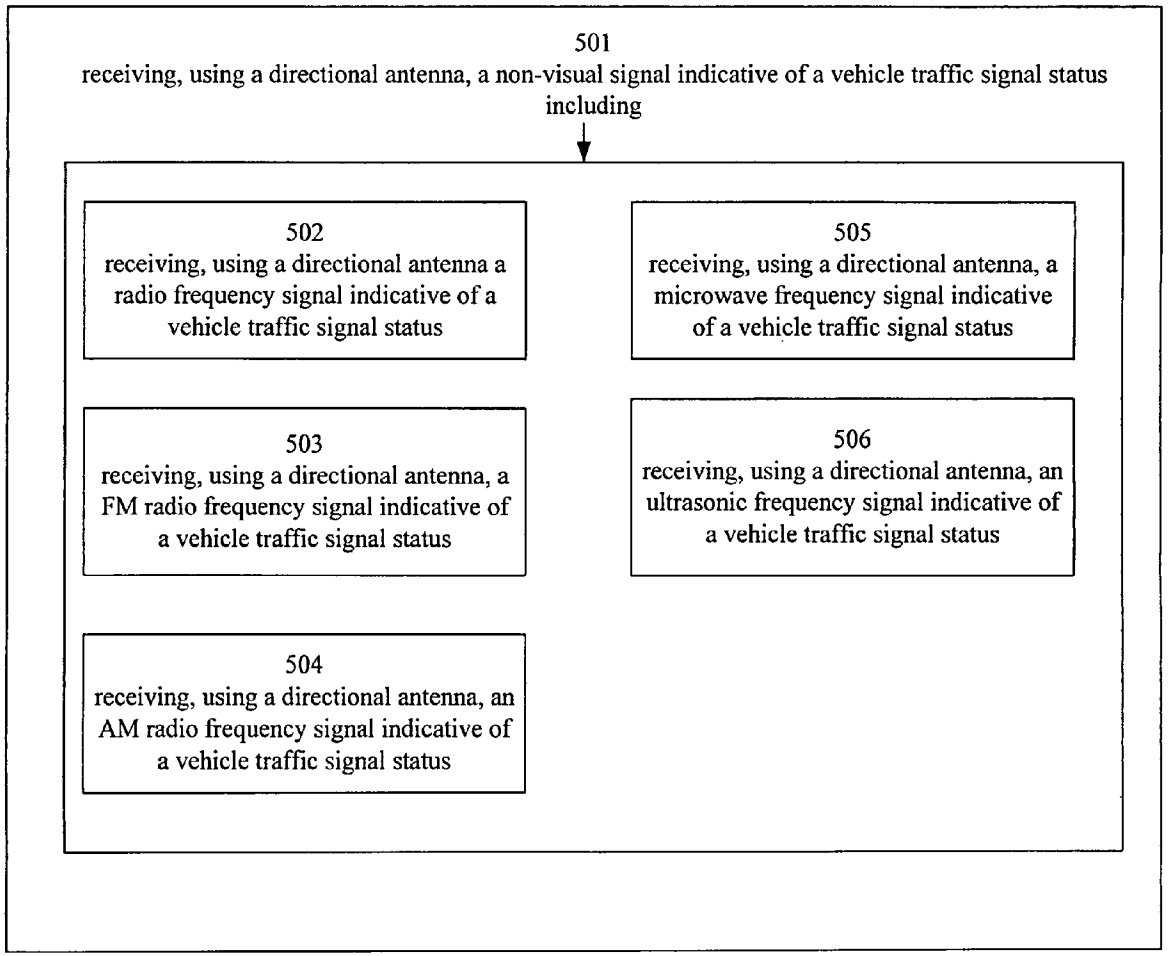
FIG. 5 is an illustration of an embodiment relating to a method.

With reference to FIG. 5, a method of receiving a non-visual and non-audible signal including information associated with the vehicle traffic status is illustrated. Reference numeral 501 includes receiving, using a directional antenna toward oncoming vehicle traffic, a non-visual and non-audible signal including information associated with the vehicle traffic signal status. Reference numeral 502 includes receiving, using a directional antenna toward oncoming vehicle traffic, a radio frequency signal including information associated with the vehicle traffic signal status. Reference numeral 503 includes receiving, using a directional antenna toward oncoming vehicle traffic, a FM frequency signal including information associated with the vehicle traffic signal status. Reference numeral 504 includes receiving, using a directional antenna toward oncoming vehicle traffic, an AM radio frequency signal including information associated with the vehicle traffic signal status. Reference numeral 505 includes receiving, using a directional antenna toward oncoming vehicle traffic, a microwave frequency signal including information associated with the vehicle traffic signal status. Reference numeral 506 includes receiving, using a directional antenna toward oncoming vehicle traffic, an ultrasonic frequency signal including information associated with the vehicle traffic signal status.

Figure 6:
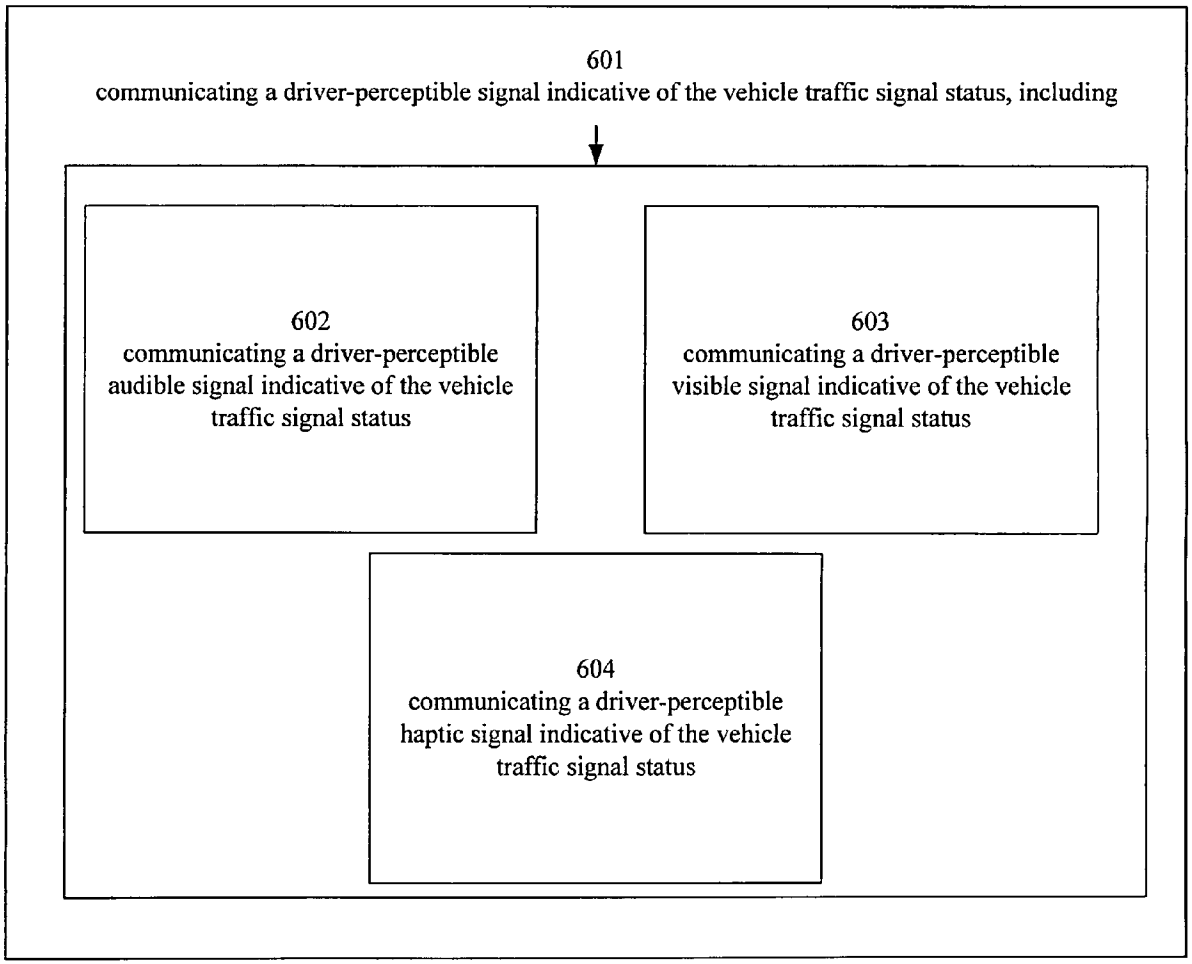
FIG. 6 is an illustration of an embodiment relating to a method.

With reference to FIG. 6, a method of communicating a driver-perceptible signal indicative of a traffic status is illustrated. Reference numeral 601 includes communicating a driver-perceptible signal indicative of the vehicle traffic signal status. Reference numeral 602 includes communicating a driver-perceptible audible signal indicative of the vehicle traffic signal status. Reference numeral 603 includes communicating a driver-perceptible visible signal indicative of the vehicle traffic signal status. Reference numeral 604 includes communicating a driver-perceptible haptic signal indicative of the vehicle traffic signal status.

As used herein, "circuitry" includes an electronic circuit and can include any of digital circuits, analog circuits, or a mixture thereof. The state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any circuitry to be utilized is a choice dependent upon the context in which the circuitry will be deployed and the specific concerns (e.g., speed, flexibility, or predictability) of the implementer, any of which may vary. Those skilled in the art will recognize that optical aspects of implementations will require optically-oriented hardware, software, and or firmware.

The foregoing detailed description has set forth various embodiments of the devices and/or processes via the use of block diagrams, flow diagrams, operation diagrams, flowcharts, illustrations, and/or examples. Insofar as such block diagrams, operation diagrams, flowcharts, illustrations, and/or examples contain one or more functions and/or operations, it will be understood by those within the art that each function and/or operation within such block diagrams, operation diagrams, flowcharts, illustrations, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in standard integrated circuits, as one or more computer programs running on one or more computers (e.g., as one or more programs running on one or more computer systems), as one or more programs, or algorithms running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, the mechanisms of the subject matter described herein are capable of being distributed as a program product in a variety of forms, and that an illustrative embodiment of the subject matter described herein applies equally regardless of the particular type of signal bearing media used to actually carry out the distribution.

While particular aspects of the present subject matter described herein have been shown and described, it will be apparent to those skilled in the art that, based upon the teachings herein, changes and modifications may be made without departing from this subject matter described herein and its broader aspects and, therefore, the appended claims are to encompass within their scope all such changes and modifications as are within the true spirit and scope of this subject matter described herein. Furthermore, it is to be understood that the invention is solely defined by the appended claims. In general, terms used herein and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

The herein described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality. Any two components capable of being so associated can also be viewed as being "operably couplable" to each other to achieve the desired functionality. Specific examples of operably couplable include but are not limited to physically mateable and/or physically interacting components and/or wirelessly interactable and/or wirelessly interacting components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A vehicle traffic signal notification system comprising:

a receiver including circuitry configured to activate transmission circuitry upon receipt of a signal from an approaching vehicle, the transmission circuitry operably coupled to a vehicle traffic signal controller and operably coupled to a transmitter, the transmitter including at least one directional antenna; wherein the transmission circuitry is configured to receive information associated with vehicle traffic signal status from the vehicle traffic signal controller, and configured to cause the transmitter to transmit a non-visual and non-audible signal including information associated with the vehicle traffic signal status.

2. The vehicle traffic notification system of claim 1, further comprising: a mobile receiver unit including a receiver to receive the transmitted non-visual and non-audible signal including information associated with the vehicle traffic signal status; and a communication mechanism coupled to the mobile receiver unit including circuitry to communicate information indicative of the vehicle traffic signal status to a user.

3. The vehicle traffic signal notification system of claim 1, further comprising: detection circuitry operably coupled to the vehicle traffic signal controller to detect a vehicle approaching a vehicle traffic signal.

4. The vehicle traffic signal notification system of claim 1, wherein the transmitter is selected from the group consisting of a radio frequency transmitter, an AM radio frequency transmitter, a FM radio frequency transmitter, an ultrasonic frequency transmitter and a microwave frequency transmitter.

5. The vehicle traffic signal notification system of claim 2, wherein the communication mechanism is operably connected to an audio speaker to communicate an audible signal to the user.

6. The vehicle traffic signal notification system of claim 2, wherein the communication mechanism includes a display to communicate a visible signal to the user.

7. The vehicle traffic signal notification system of claim 2, wherein the communication mechanism includes an audio speaker to communicate an audible signal to the user, and a display to communicate a visible signal to the user.

8. The vehicle traffic signal notification system of claim 6, wherein the display includes a heads-up-display.

9. The vehicle traffic signal notification system of claim 2, wherein the communication mechanism is operably connected to an audio speaker to communicate an audible signal to the user; and to a display to communicate a visible signal to the user; and to a haptic mechanism to communicate a haptically-perceptible signal to the user.

10. A vehicle, comprising: a receiver unit including an antenna to receive a transmitted non-visual and non-audible vehicle traffic status signal including information associated with the vehicle traffic signal status; circuitry to process the received non-visual and non-audible vehicle traffic signal status signal; circuitry configured to process information associated with a location and speed of the vehicle; and a communication mechanism coupled to the receiver unit to determine, based on the information regarding the location and speed of the vehicle, a time in which to communicate information indicative of the vehicle traffic signal status to a user.

11. The vehicle of claim 10, wherein the receiver unit includes a directional antenna.

12. The vehicle of claim 11, wherein the receiver unit comprises a receiver unit selected from the group consisting of a radio frequency receiver, a FM radio frequency receiver, an AM radio frequency receiver, an ultrasonic frequency receiver, and a microwave frequency receiver.

13. The vehicle of claim 10, wherein the communication mechanism is operably connected to an audio speaker to communicate an audible signal indicative of the vehicle traffic signal status to a user.

14. The vehicle of claim 10, wherein the communication mechanism includes a display to communicate a visible signal indicative of the vehicle traffic signal status to a user.

15. The vehicle of claim 10, wherein the communication mechanism is operably connected to an audio speaker to communicate audible signal indicative of the vehicle traffic signal status to a user, and a display to communicate a visible signal indicative of the vehicle traffic signal status to a user.

16. A method of notifying a vehicle driver of a vehicle traffic signal status, comprising: transmitting, using a directional antenna toward the vehicle, a non-visual and non-audible signal including information associated with the vehicle traffic signal status.

17. The method of claim 16, wherein the non-visual and non-audible signal including information associated with the vehicle traffic signal status is selected from the group consisting of a radio frequency signal, an ultrasonic frequency signal, and a microwave frequency signal.

18. A method of receiving information associated with a vehicle traffic signal status, comprising: receiving, using a directional antenna, a non-visual and non-audible signal including information associated with the vehicle traffic signal status; receiving information associated with a location and speed of a vehicle; determining a time remaining until the vehicle must stop, and communicating information indicative of the vehicle traffic signal status to a user at a time based on the received information associated with the location and speed of the vehicle.

19. The method of claim 18, wherein the non-visual and non-audible signal including information associated with the vehicle traffic signal status includes a signal selected from the group consisting of a radio frequency signal, an ultrasonic frequency signal, and a microwave frequency signal.

20. The method of claim 18, wherein the communicating includes communicating an audible signal indicative of the vehicle traffic signal status to the user.

21. The method of claim 18, wherein the communicating includes displaying a visible signal indicative of the vehicle traffic signal status to the user.

22. The method of claim 18, wherein the communicating includes communicating an audible signal indicative of the vehicle traffic signal status to the user, and a displaying a visible signal indicative of the vehicle traffic signal status to the user.

* * * * *